US005275256A

United States Patent [19]

Ellzey

[11] Patent Number: 5,275,256

[45] Date of Patent: Jan. 4, 1994

[54] LADDER CARRIAGE APPARATUS

[76] Inventor: Floyd D. Ellzey, 319 E. Ohio St., Clinton, Mo. 64735

[21] Appl. No.: 889,185

[22] Filed: May 28, 1992

[51] Int. Cl.[5] ..... E06C 7/16

[52] U.S. Cl. ..... 182/103; 182/129; 248/238; 104/246

[58] Field of Search ..... 182/103, 129; 248/210, 248/238, 311.2; 104/232, 233, 234, 246

[56] References Cited

U.S. PATENT DOCUMENTS

| | | | |
|---|---|---|---|
| 2,438,791 | 3/1948 | Russell | 182/103 |
| 3,437,314 | 4/1969 | Minor | 104/232 X |
| 4,550,806 | 11/1985 | Bocker | 182/103 X |

FOREIGN PATENT DOCUMENTS

| | | | |
|---|---|---|---|
| 138912 | 11/1979 | Fed. Rep. of Germany | 182/103 |

*Primary Examiner*—Blair M. Johnson

*Attorney, Agent, or Firm*—Leon Gilden

[57] ABSTRACT

An apparatus having first and second floor plates defining a floor opening to receive a ladder therethrough is provided, with the floor plates having first and second side plates mounted to opposed ends of the floor plates, with the side plates arranged in a parallel coextensive relationship. At least one of the side plates includes a support container, and optionally, both side plates may include support containers hingedly mounted to permit pivotment together in adjacency forwardly of the apparatus. Roller structure is mounted interiorly of the side plates to guide and direct ladder legs of the ladder within the floor opening. Further, a brake lever is arranged for engagement relative to a rear wheel guide for selective positioning of the organization relative to the ladder. A floor hook cooperative with a ladder rung pulley for selective securement to an associated ladder rung is arranged to permit selective lifting of the carriage apparatus relative to the ladder.

8 Claims, 5 Drawing Sheets

LADDER CARRIAGE APPARATUS

BACKGROUND OF THE INVENTION

1. Field of the Invention

The field of invention relates to ladder support structure, and more particularly pertains to a new and improved ladder carriage apparatus wherein the same permits the selective positioning and mounting of a support container structure relative to a ladder assembly.

2. Description of the Prior Art

Support container structure of various types are utilized throughout the prior art to provide for the positioning and mounting of paint assisting components and structure relative to a ladder assembly. Such apparatus is exemplified in U.S. Pat. No. 4,815,684 to Kellstad wherein a paint pan is fixedly mounted relative to a support bracket that in turn is secured to the ladder rung of an associated ladder.

U.S. Pat. No. 4,949,925 to Gorecki sets forth a ladder caddy having a container arranged for relatively fixed positioning to a ladder structure.

Further examples of step-ladder type tray support structure is exemplified in the U.S. Pat. Nos. 4,874,147 to Ory, et al.; 4,318,523 to Weatherly; and 4,310,134.

The prior art has heretofore failed to provide for the mobility available as set forth by the instant invention to permit selectively positioning and latching of container structure relative to a ladder assembly and in this respect, the present invention substantially fulfills this need.

SUMMARY OF THE INVENTION

In view of the foregoing disadvantages inherent in the known types of ladder support tray structure now present in the prior art, the present invention provides a ladder carriage apparatus wherein the same is arranged for ease of adjustment and displacement relative to a ladder assembly. As such, the general purpose of the present invention, which will be described subsequently in greater detail, is to provide a new and improved ladder carriage apparatus which has all the advantages of the prior art ladder supported tray structure and none of the disadvantages.

To attain this, the present invention provides an apparatus having first and second floor plates defining a floor opening to receive a ladder therethrough, with the floor plates having first and second side plates mounted to opposed ends of the floor plates, with the side plates arranged in a parallel coextensive relationship. At least one of the side plates includes a support container, and optionally, both side plates may include support containers hingedly mounted to permit pivotment together in adjacency forwardly of the apparatus. Roller structure is mounted interiorly of the side plates to guide and direct ladder legs of the ladder within the floor opening. Further, a brake lever is arranged for engagement relative to a rear wheel guide for selective positioning of the organization relative to the ladder. A floor hook cooperative with a ladder ring pulley for selective securement to an associated ladder rung is arranged to permit selective lifting of the carriage apparatus relative to the ladder.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder carriage apparatus which has all the advantages of the prior art ladder tray supports and none of the disadvantages.

It is another object of the present invention to provide a new and improved ladder carriage apparatus which may be easily and efficiently manufactured and marketed.

It is a further object of the present invention to provide a new and improved ladder carriage apparatus which is of a durable and reliable construction.

An even further object of the present invention is to provide a new and improved ladder carriage apparatus which is susceptible of a low cost of manufacture with regard to both materials and labor, and which accordingly is then susceptible of low prices of sale to the consuming public, thereby making such ladder carriage apparatus economically available to the buying public.

Still yet another object of the present invention is to provide a new and improved ladder carriage apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
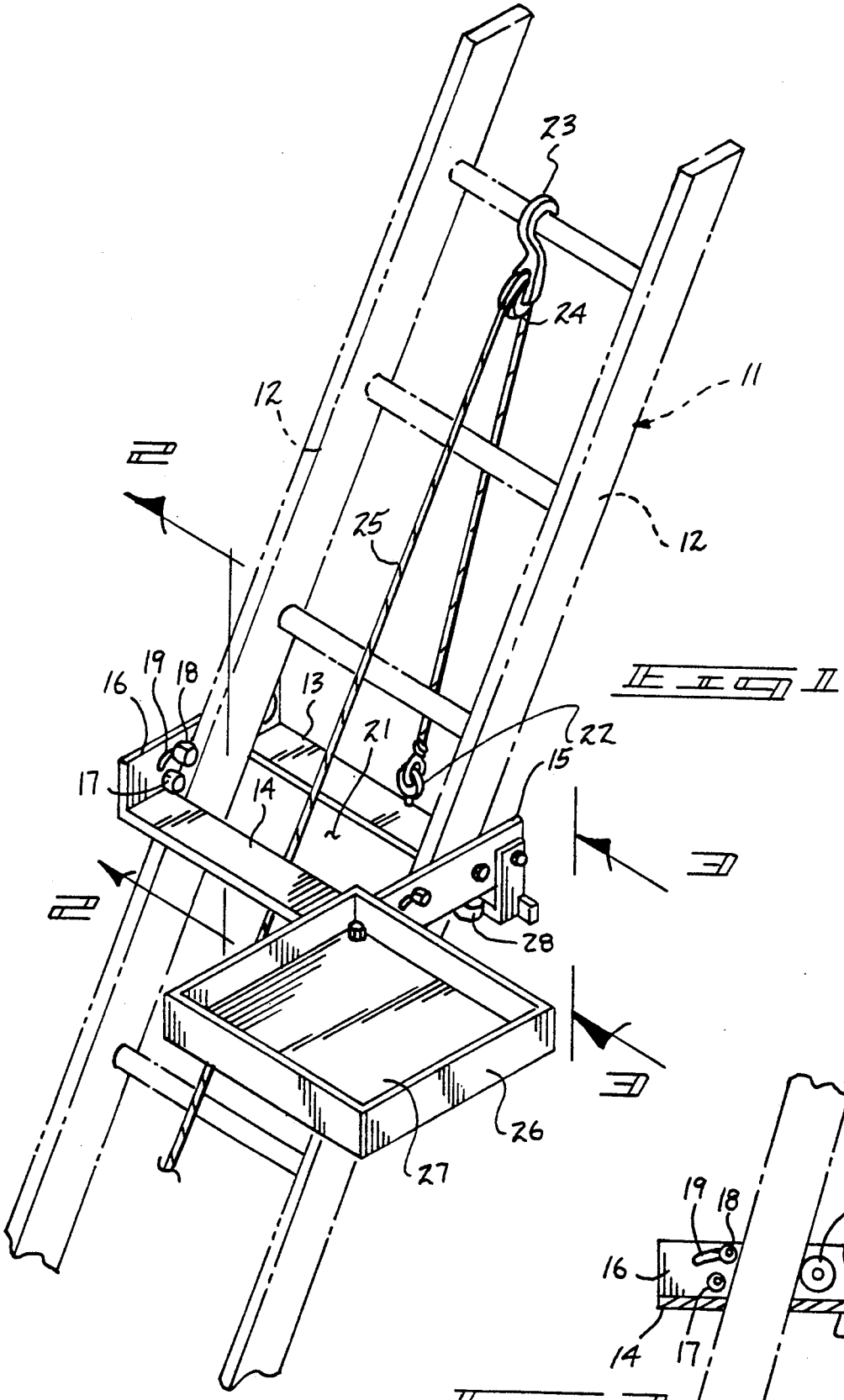
FIG. 1 is an isometric illustration of the invention.
Figure 2:
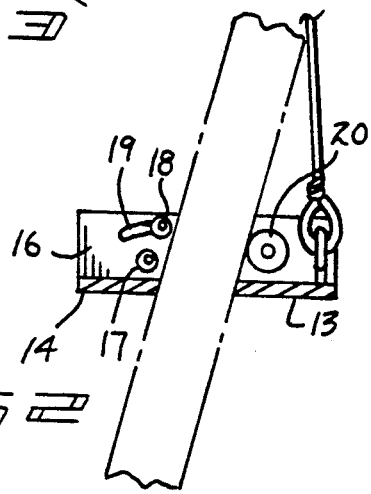
FIG. 2 is an orthographic view, taken along the lines 2—2 of FIG. 1 in the direction indicated by the arrows.
Figure 3:
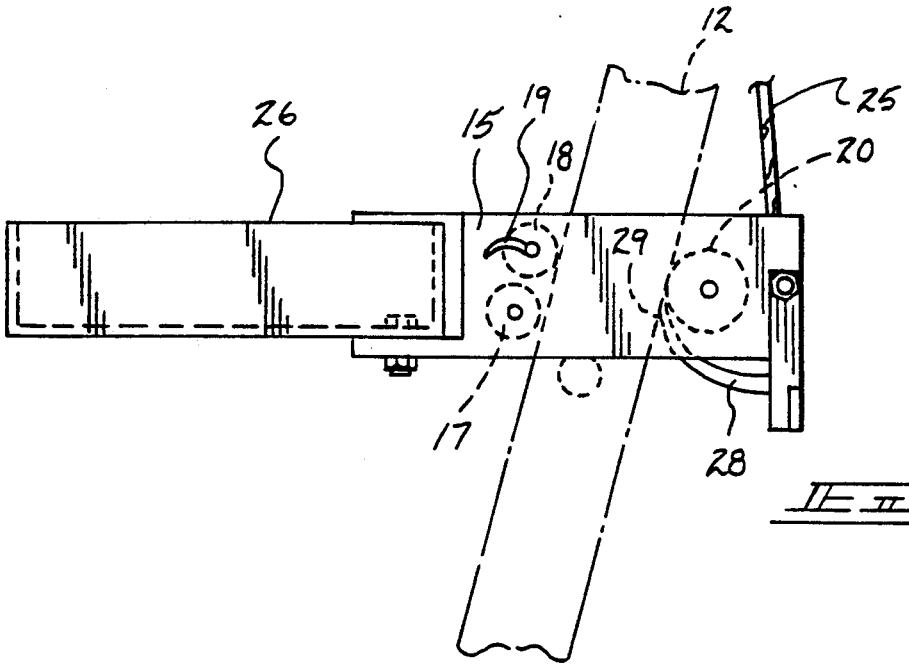
FIG. 3 is an orthographic view, taken along the lines 3—3 of FIG. 1 in the direction indicated by the arrows.

With reference now to the drawings, and in particular to FIGS. 1 to 8 thereof, a new and improved ladder carriage apparatus embodying the principles and concepts of the present invention and generally designated by the reference numeral 10 will be described.

More specifically, the ladder carriage apparatus 10 of the instant invention essentially comprises the apparatus mounted in an adjustable relationship longitudinally along a ladder member 11 formed with ladder legs 12 having rungs directed orthogonally between the ladder legs at spaced intervals therebetween. A first floor plate 13 is arranged in a parallel, spaced, and coextensive as well as coplanar relationship relative to a second floor plate 14 defining a ladder receiving floor opening 21 directed therebetween. Respective first and second side plates 15 and 16 are arranged in a parallel and coextensive relationship at opposed ends of the first and second floor plates 13 and 14. A first fixed roller 17 is mounted to an interior and confronting surface of each of the side plates positioned adjacent the second floor plate 14 in adjacency to the floor opening 21. A first adjustable roller 18 is movably mounted within an arcuate slot 19 that is oriented above each fixed roller 17 of each side plate, with the arcuate slot 19 extending to a position over the floor opening 21 from the second floor plate 14. A second fixed roller 20 is mounted to each interior and confronting surface of the side plates 15 and 16 and positioned above the first floor plate 13 in adjacency to the floor opening 21. The first and second fixed rollers in cooperation with the adjustable roller that in turn may be spring biased towards the floor opening at a forwardmost extend of the arcuate slot 19 operate in concert to position the ladder legs 12. Further it should be noted that the ladder legs 12 are spaced apart a predetermined spacing substantially equal to a spacing between the side plates 15 and 16. One of the side plates includes a pivotally mounted flange having a brake arm 28 mounted thereto, with the brake arm extending from a position below the first floor plate 13 for an orientation spaced from the floor opening 21 to a second position projecting into the floor opening into contiguous communication between the second fixed roller 20 and an associated ladder leg 12. A first floor plate hook 22 is mounted medially to a top surface of the first floor plate 13, including cooperation with a ladder rung hook 23 that is arranged for selective positioning to a ladder rung positioned above the first floor plate. A pulley 24 is mounted to the ladder rung hook 23, with a lift rope 25 fixedly mounted at a first end to the first floor plate hook 22 and extending over the pulley 24 to a position through the floor opening 21 and extending therebelow. In this manner, lifting of the first and second floor plates, as well as the attendant structure by the lift rope, is provided, whereupon release of pressure effects weight of the organization directed onto the rollers 17, 18, and 20 in cooperation with the brake arm 28.

Figure 4:
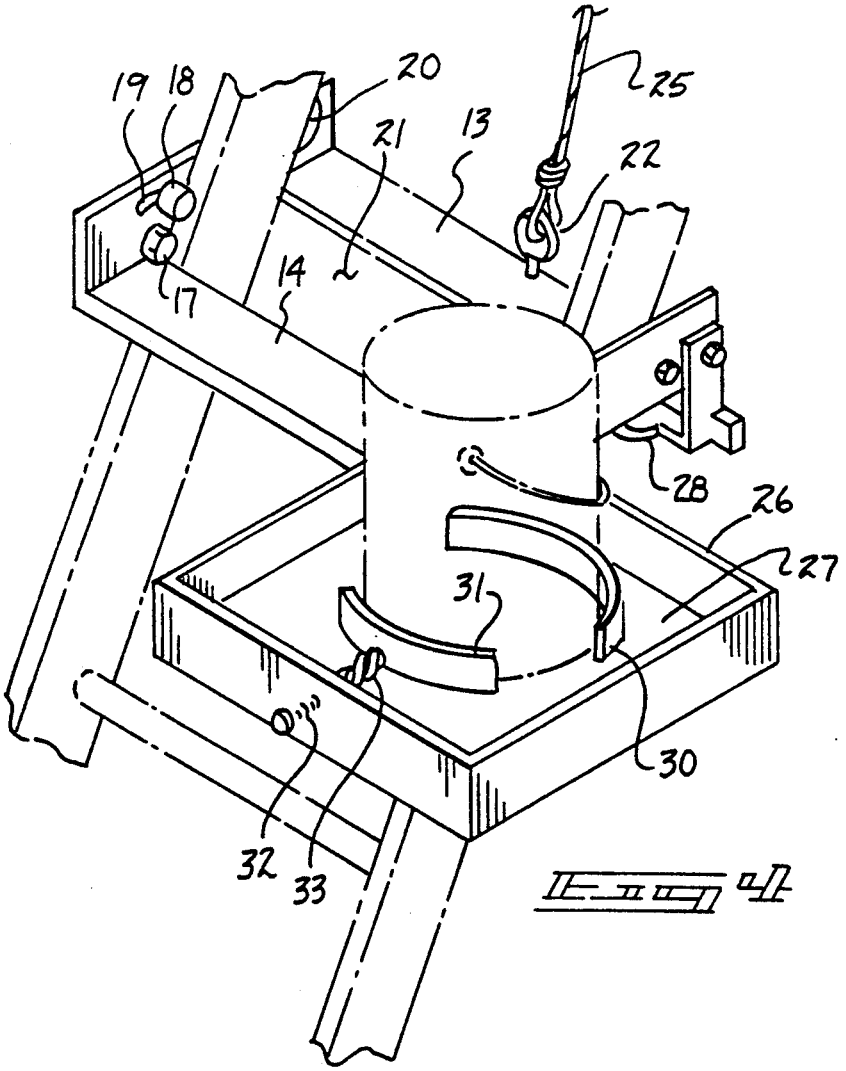
FIG. 4 is an isometric illustration of the container structure having adjusting rings mounted to the floor thereof.
Figure 5:
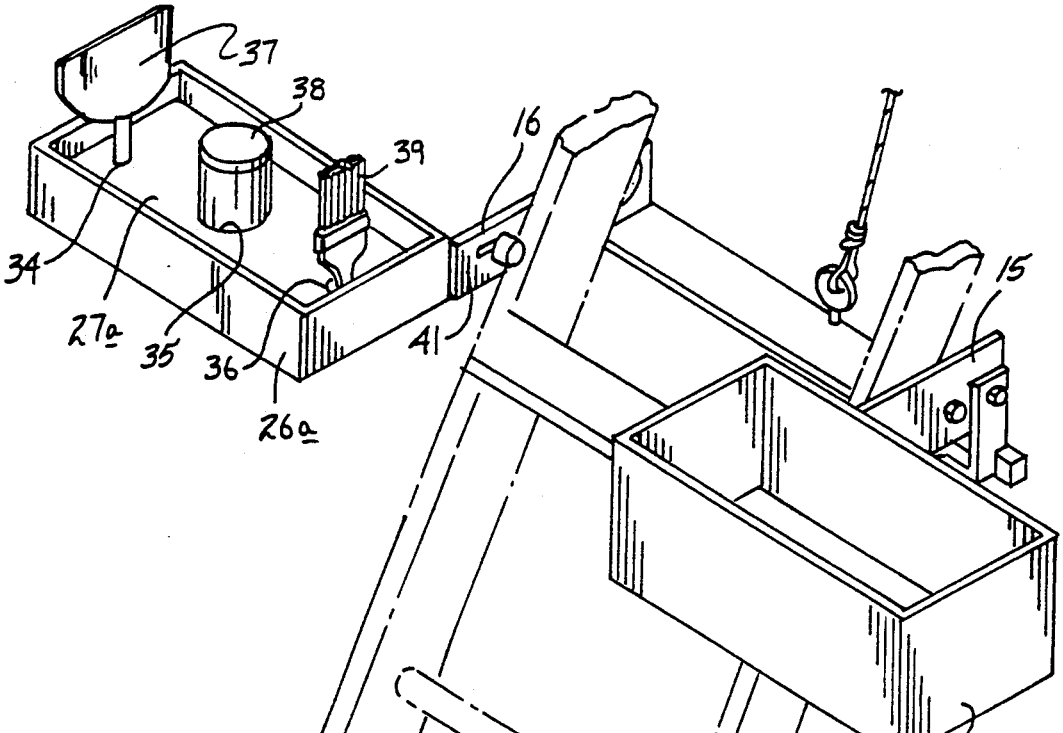
FIG. 5 is an isometric illustration of the invention having a plurality of support containers.
Figure 6:
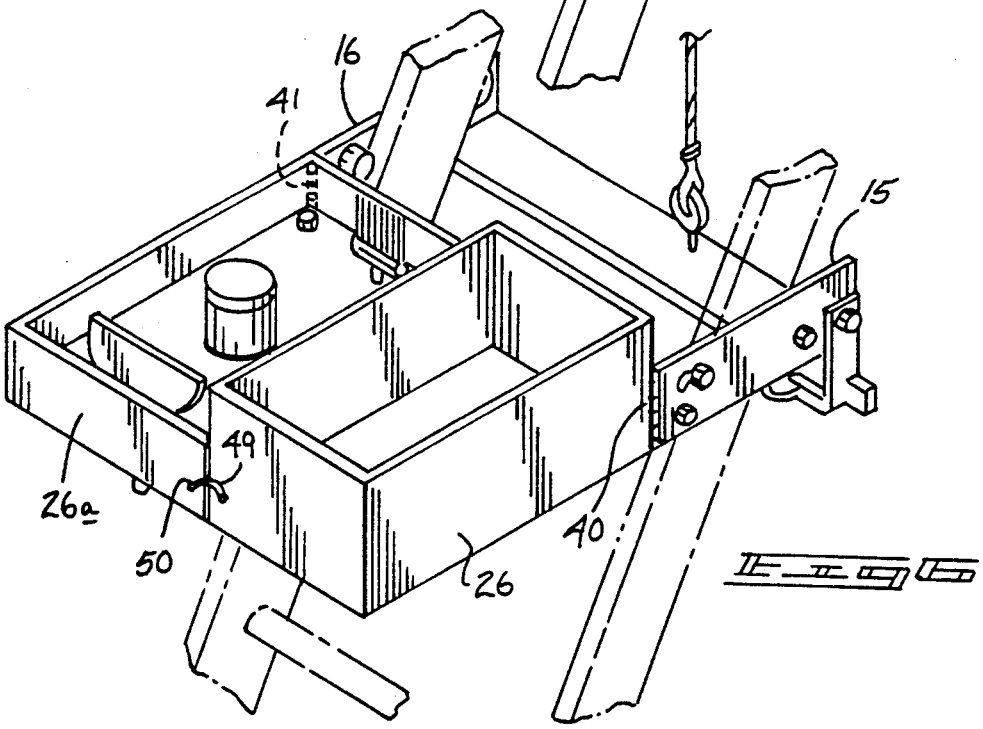
FIG. 6 is an isometric illustration of the plurality of support containers pivoted to a confronting relationship relative to one another.

A support container 26 is mounted to an exterior surface of one of the side plates 15 or 16, as illustrated in FIGS. 1–4 for example, forwardly of the ladder legs in adjacency to the second side plate 14 spaced from the first side plate 13. The support container 26 includes a support container floor 27 for positioning and storing various components thereon, such as painting accessories. The support container 26, as illustrated in FIG. 4, is afforded an arcuate flange 30 positioned in confronting relationship relative to a movable arcuate flange 31. The movable arcuate flange 31 includes a threaded rod 32 mounted medially of the movable flange 31 and projecting through a side wall of the container 26. A spring member 33 captured between the movable flange 31 and the aforenoted side wall of the container 26 biases positioning of the movable flange towards the fixed flange to position components such as a bucket therebetween.

Figure 7:
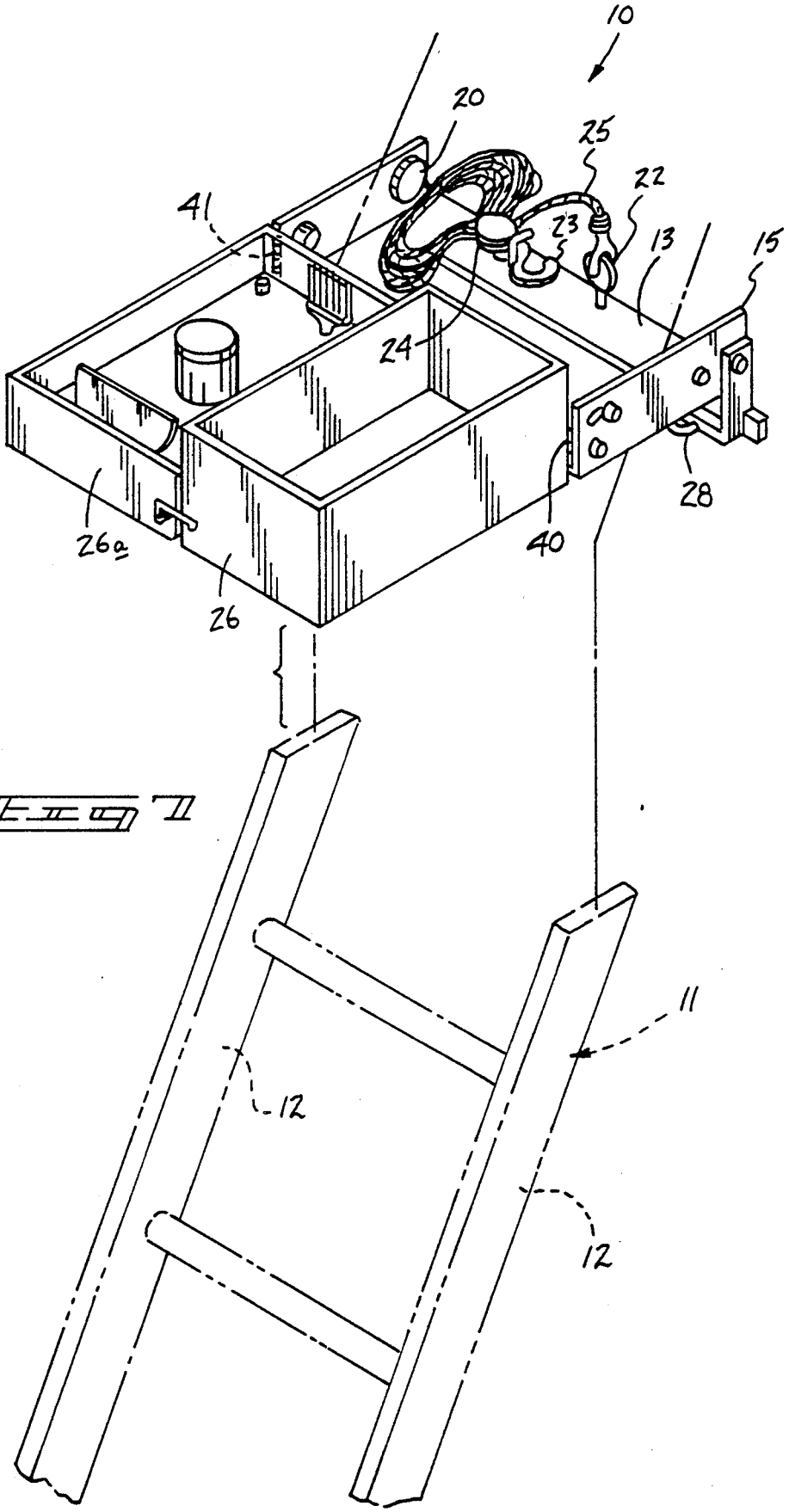
FIG. 7 is an isometric illustration of the invention prior to securement to the ladder assembly.

A second support container 26*a* is mounted to the second side plate 16. In the organization as illustrated in the FIGS. 5 and 6 for example, a first hinge 40 pivotally mounts the container 26 to the first side plate 15, with a second hinge 41 (see FIG. 6) pivotally mounting the second container 26*a* to the second side plate. The second support container is provided with a second support container floor 27*a* having respective first, second, and third floor apertures 34, 35, and 36 directed therethrough to secure various painting components such as a scraping tool 37, a paint container 38, and a brush 39 through the apertures 34–36 respectively. When the containers 26 and 26*a* are pivoted in adjacency relative to one another, a latch hook 49 mounted to the first container 26 cooperates with a latch hook 50 mounted to the second container 26*a* to secure the containers in the forward position for transport and storage thereof and assist in initial positioning of the organization relative to the ladder member 11, in a manner as illustrated in FIG. 7.

Figure 8:
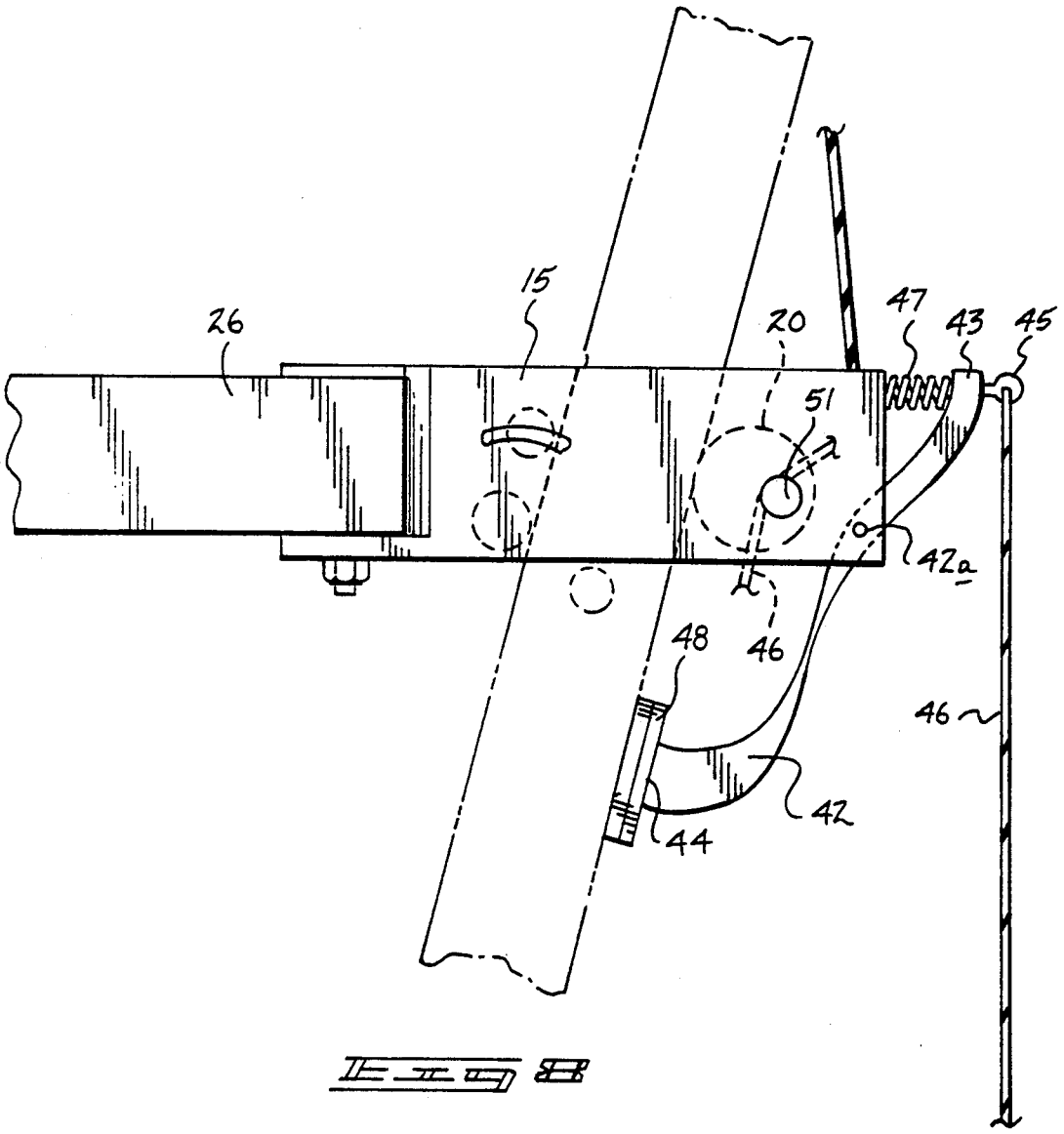
FIG. 8 is an orthographic side view of the invention illustrating the use of a further brake assembly.

The FIG. 8 illustrates a modified brake construction in lieu of the brake arm 28, with a brake arm 42 pivotally mounted about a brake arm pivot axle 42*a*. The brake arm 42 includes a first end 43 extending above the first floor plate 13 cooperating with a forward end of the first side plate 15 utilizing a brake arm spring 47 interposed between the first end 43 and the forward end of the first side plate. A brake arm hook 45 is mounted to the first end of the brake arm spaced from the spring 47 and includes a release cable 46. A guide boss 51 is mounted to an exterior surface of the first side plate 15 between the second side plate 16 and the brake arm pivot axle 42*a*. A brake arm second end 44 includes a friction pad 48 mounted thereto for engagement with one of the ladder legs 12. Release of the brake arm from above the first side plate 13 effects mere lifting of the release cable 46 to effect release of the friction pad 48 and the brake arm relative to the ladder leg. To release the brake arm in association with the ladder leg from below, the release cable 46 is directed over the guide boss 51 that is forwardly of the brake arm pivot axle to effect displacement of the friction pad relative to the ladder member 11. In this manner, release of the adjustment of the organization along the ladder member is permitted.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ladder carriage apparatus arranged in cooperation relative to a ladder member having ladder legs, with ladder rungs directed orthogonally between the ladder legs, wherein the apparatus comprises, a first floor plate spaced from a second floor plate in a parallel coplanar and coextensive relationship forming a floor opening between the first floor plate and the second floor plate, and a first side plate and a second side plate arranged in a parallel and coextensive spaced relationship orthogonally mounted to the first floor plate and second floor plate, with the floor opening oriented between the first side plate and the second side plate, and the first side plate including a first side plate interior surface and the second side plate including a second side plate interior surface, wherein the first side plate interior surface and the second side plate interior surface are arranged in confronting relationship relative to one another, and the first side plate interior surface includes a first fixed roller rotatably mounted to the first side plate interior surface over the second floor plate in adjacency to the floor opening for cooperation with one of said ladder legs, and a first adjustable roller mounted above the first fixed roller, and an arcuate slot directed through the first side plate extending from above the second side plate to a forward orientation over the floor opening, and the first adjustable roller directed along the arcuate slot and projecting from the first side plate interior surface, and a second fixed roller rotatably mounted to the second side floor plate interior surface above the first floor plate in adjacency to the floor opening, and brake means mounted to the first side plate for effecting selective arresting of movement of the first side plate relative to the ladder member.

2. An apparatus as set forth in claim 1 including a support container including a first hinge hingedly mounting the first floor container to the first side plate in adjacency to the second floor plate.

3. An apparatus as set forth in claim 2 including a second support container having a second hinge hingedly mounting the second support container to the second side plate in adjacency to the second floor plate.

4. An apparatus as set forth in claim 3 wherein the support container includes a latch hook, and the second support container includes a latch loop, with the latch hook arranged for selective projection to the latch loop, and the support container and the second support container arranged for pivotment from a first position in a spaced relationship to a second position in adjacency relative to one another to permit projection to the support loop.

5. An apparatus as set forth in claim 4 wherein the second support container includes a second support container floor, wherein the second support container floor includes a plurality of apertures directed therethrough, and each aperture of said plurality of apertures arranged to receive a tool member therethrough.

6. An apparatus as set forth in claim 5 wherein the first floor plate includes a first floor plate hook fixedly mounted to the floor plate medially thereof, and a lift rope, the lift rope having a lift rope first end, the lift rope first end secured to the first floor plate hook, and a pulley, the lift rope directed along the pulley, and the pulley rotatably mounted to a ladder rung hook, with the ladder rung hook arranged for securement to one of the ladder rungs of the ladder member.

7. An apparatus as set forth in claim 6 wherein the support container includes a support container floor, and the support container floor includes a fixed arcuate flange fixedly mounted to the support container floor, and a movable arcuate flange movably mounted along the support container floor in confrontation with the fixed arcuate flange, and the movable arcuate flange including a movable flange threaded rod fixedly mounted to the movable flange medially of the movable flange, the support container including a support container side wall, and the movable flange threaded rod directed through the side wall, with a spring member interposed between the side wall and the movable arcuate flange.

8. An apparatus as set forth in claim 7 wherein the brake means includes a brake arm, and the brake arm pivotally mounted about a pivot axle, with the pivot axle directed through the first side plate, the first side plate including a first side plate forward end in adjacency to the first floor plate, and the pivot axle is directed through the first side plate in adjacency to the first side plate forward end, and the brake arm including a first end projecting above the first side plate, and the brake arm including a second end projecting below the first side plate, the first end including a first end hook, the first end hook including a release cable mounted to the first end hook, and a brake arm spring positioned between the brake arm first end and the first side plate forward end, and a guide boss mounted to an exterior surface of the first side plate between the second floor plate and the brake arm pivot axle, with the brake arm release cable arranged for selective projection over the guide boss to effect release of the brake arm relative to the ladder member from an orientation below the first floor plate, and the brake arm second end having a brake arm friction pad mounted thereon for engagement with the ladder member.

* * * * *